US008729783B2

(12) United States Patent
Tanaka et al.

(10) Patent No.: US 8,729,783 B2
(45) Date of Patent: May 20, 2014

(54) SPARK PLUG ELECTRODE, METHOD FOR PRODUCING SAME, SPARK PLUG, AND METHOD FOR PRODUCING SPARK PLUG

(75) Inventors: Tomo-o Tanaka, Kitanagoya (JP); Tsutomu Shibata, Owariasahi (JP); Takaaki Kikai, Ama (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/824,205

(22) PCT Filed: Aug. 24, 2011

(86) PCT No.: PCT/JP2011/069078

§ 371 (c)(1),
(2), (4) Date: Mar. 15, 2013

(87) PCT Pub. No.: WO2012/039229

PCT Pub. Date: Mar. 29, 2012

(65) Prior Publication Data

US 2013/0181597 A1 Jul. 18, 2013

(30) Foreign Application Priority Data

Sep. 24, 2010 (JP) ..... 2010-213831

(51) Int. Cl.
*H01T 13/20* (2006.01)

(52) U.S. Cl.
USPC ..... 313/141; 313/118; 445/7

(58) Field of Classification Search
USPC ..... 313/141, 118; 445/7
See application file for complete search history.

(56) References Cited

U.S. PATENT DOCUMENTS

| | | | | |
|---|---|---|---|---|
| 5,578,894 | A | 11/1996 | Oshima | |
| 6,121,719 | A | 9/2000 | Matsutani et al. | |
| 7,508,121 | B2 * | 3/2009 | Lykowski | 313/118 |
| 2007/0159046 | A1 | 7/2007 | Yoshimoto et al. | |
| 2013/0181596 | A1 * | 7/2013 | Tanaka et al. | 313/141 |

FOREIGN PATENT DOCUMENTS

| | | | |
|---|---|---|---|
| JP | 05-343157 | A | 12/1993 |
| JP | 07-037678 | A | 2/1995 |
| JP | 11-154584 | A | 6/1999 |
| JP | 2007-165291 | A | 6/2007 |
| JP | 2008-218249 | A | 9/2008 |

OTHER PUBLICATIONS

International Search Report mailed Nov. 29, 2011 for the corresponding PCT Application No. PCT/JP2011/069078.

* cited by examiner

*Primary Examiner* — Mary Ellen Bowman
(74) *Attorney, Agent, or Firm* — Leason Ellis, LLP.

(57) ABSTRACT

A spark plug is provided having at least one of a center electrode or a ground electrode. The electrode comprises: a core formed of a composite material containing a matrix metal, the matrix metal being copper or a metal containing copper as a main component, and carbon dispersed in the matrix metal in an amount of 10 to 80 vol. %, the carbon having a thermal conductivity higher than that of the matrix metal. The electrode also contains an outer shell which surrounds the core and which is formed of nickel or a metal containing nickel as a main component. The thus-produced electrode exhibits favorable thermal conductivity and good heat dissipation, by virtue of the small difference in thermal expansion coefficient between the core and an outer shell. The spark plug including the above electrode exhibits excellent durability.

15 Claims, 3 Drawing Sheets

SPARK PLUG ELECTRODE, METHOD FOR PRODUCING SAME, SPARK PLUG, AND METHOD FOR PRODUCING SPARK PLUG

CROSS-REFERENCE TO RELATED PATENT APPLICATIONS

This application is a U.S. National Phase Application under 35 U.S.C. §371 of International Patent Application No. PCT/JP2011/069078, filed Aug. 24, 2011, and claims the benefit of Japanese Patent Application No. 2010-213831, filed Sep. 24, 2010, all of which are incorporated by reference herein. The International Application was published in Japanese on Mar. 29, 2012 as International Publication No. WO/2012/039229 under PCT Article 21(2).

FIELD OF THE INVENTION

The present invention relates to a spark plug electrode; a method for producing the electrode; a spark plug; and a method for producing the spark plug.

BACKGROUND OF THE INVENTION

With the progress of high-performance internal combustion engines, a center electrode or ground electrode of a spark plug for such an internal combustion engine tends to be used at higher temperatures. Since the material of such an electrode may be degraded through heat accumulation by combustion, the electrode is required to have high thermal conductivity for achieving good heat dissipation. Therefore, there has been proposed employment of an electrode including an outer shell formed of a nickel alloy exhibiting excellent corrosion resistance, and a core formed of a metal having a thermal conductivity higher than that of the nickel alloy <see, for example, Japanese Patent Application Laid-Open (kokai) No. H05-343157>.

Problems to be Solved by the Invention

Copper is preferably employed as a core material, by virtue of its high thermal conductivity. However, when an outer shell is formed of a nickel alloy, the difference in thermal expansion coefficient between the outer shell and the core increases, and clearances are formed at the boundary between the outer shell and the core, which is caused by deformation of the core due to thermal stress. Therefore, the heat dissipation of the electrode material is lowered, and the service life of the resultant spark plug is shortened. Formation of such clearances at the boundary between the outer shell and the core may be prevented by decreasing the difference in thermal expansion coefficient between the outer shell and the core. In this case, the nickel alloy forming the outer shell plays a role in imparting corrosion resistance to the electrode, and copper forming the core plays a role in imparting high thermal conductivity to the electrode. Therefore, the composition of the electrode material cannot be varied greatly. The aforementioned problem (due to deformation of the core) may be solved by increasing the strength of the core. For example, conceivable means for solving the problem is to strengthen the core material through formation of a solid solution (i.e., alloying of the core material). However, the thus-alloyed core material exhibits a thermal conductivity lower than that of copper alone, which does not lead to a considerable improvement in properties of the electrode.

A conceivable approach for increasing the strength of the core is to suppress grain growth during overheating by dispersing ceramic powder in the core. However, in this case, the thermal conductivity of the core is lowered, since the ceramic powder exhibits thermal conductivity lower than that of copper. In addition, when the ceramic powder comes into contact with a working jig (e.g., a machining jig, a cutting jig, or a molding die), the ceramic powder may cause a problem in that the service life of the working jig is shortened due to wear between the powder and the jig.

The core material employed may be, for example, nickel or iron, which has a thermal expansion coefficient similar to that of a nickel alloy, exhibits high strength, and is less expensive than copper. However, the thermal conductivity of nickel or iron is lower than that of Cu.

In view of the foregoing, an object of the present invention is to provide a spark plug electrode including an outer shell formed of a nickel alloy, and a core, which electrode can endure thermal stress generated in the outer shell and the core, suppresses formation of clearances due to deformation, maintains good thermal conductivity, and exhibits heat dissipation higher than that of copper. Another object of the present invention is to provide a spark plug including the electrode and exhibiting excellent durability.

SUMMARY OF THE INVENTION

Means for Solving the Problems

In order to achieve the aforementioned objects, the present invention provides the following.

(1) A spark plug electrode serving as at least one of a center electrode and a ground electrode for a spark plug, the electrode being characterized by comprising a core formed of a composite material containing a matrix metal, the matrix metal being copper or a metal containing copper as a main component, and carbon dispersed in the matrix metal in an amount of 10 to 80 vol. %, the carbon having a thermal conductivity higher than that of the matrix metal; and an outer shell which surrounds at least a portion of the core and which is formed of nickel or a metal containing nickel as a main component.

(2) A spark plug electrode according to (1) above, wherein the carbon exhibits a thermal conductivity of 450 W/m·K or more.

(3) A spark plug electrode according to (1) or (2) above, wherein the composite material exhibits a thermal conductivity of 450 W/m·K or more.

(4) A spark plug electrode according to any one of (1) to (3) above, wherein the carbon is at least one species selected from among carbon powder, carbon fiber, and carbon nanotube.

(5) A spark plug electrode according to (4) above, wherein the carbon powder has a mean particle size of 2 μm to 200 μm.

(6) A spark plug electrode according to (4) above, wherein the carbon fiber has a mean fiber length of 2 μm to 2,000 μm.

(7) A spark plug electrode according to (4) above, wherein a mean length of the carbon nanotube in the longitudinal direction is 0.1 μm to 2,000 μm.

(8) A spark plug comprising:

an insulator having an axial hole extending in a direction of an axis;

a center electrode held in the axial hole;

a metallic shell provided around the insulator; and a ground electrode which is provided such that a proximal end portion of the ground electrode is bonded to the metallic shell, and a gap is formed between a distal end portion of the ground electrode and a front end portion of the center electrode, characterized in that at least one of the center electrode and the ground electrode is an electrode as recited in any one of (1) to (7) above.

(9) A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method being characterized in that:

a step of producing at least one of the center electrode and the ground electrode includes mixing a matrix metal, the matrix metal being copper or a metal containing copper as a main component, with carbon having a thermal conductivity higher than that of the matrix metal so that the carbon content of the resultant mixture is adjusted to 10 to 80 vol. %; subjecting the mixture to powder compacting or sintering, to thereby form a core; placing the core in a cup formed of nickel or a metal containing nickel as a main component; and subjecting the cup to cold working.

(10) A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method being characterized in that:

a step of producing at least one of the center electrode and the ground electrode includes preparing a molten product of a matrix metal, the matrix metal being copper or a metal containing copper as a main component; impregnating a calcined product of carbon having a thermal conductivity higher than that of the matrix metal with the matrix metal so that the carbon content of the impregnated product is adjusted to 10 to 80 vol. %, to thereby form a core; placing the core in a cup formed of nickel or a metal containing nickel as a main component; and subjecting the cup to cold working.

(11) A method for producing at least one of a center electrode and a ground electrode for a spark plug, characterized by comprising mixing a matrix metal, the matrix metal being copper or a metal containing copper as a main component, with carbon having a thermal conductivity higher than that of the matrix metal so that the carbon content of the resultant mixture is adjusted to 10 to 80 vol. %; subjecting the mixture to powder compacting or sintering, to thereby form a core; placing the core in a cup formed of nickel or a metal containing nickel as a main component; and subjecting the cup to cold working so as to achieve a specific shape.

(12) A method for producing at least one of a center electrode and a ground electrode for a spark plug, characterized by comprising preparing a molten product of a matrix metal, the matrix metal being copper or a metal containing copper as a main component; impregnating a calcined product of carbon having a thermal conductivity higher than that of the matrix metal with the matrix metal so that the carbon content of the impregnated product is adjusted to 10 to 80 vol. %, to thereby form a core; placing the core in a cup formed of nickel or a metal containing nickel as a main component; and subjecting the cup to cold working so as to achieve a specific shape.

Effects of the Invention

According to the spark plug electrode of the present invention, by virtue of the small difference in thermal expansion coefficient between an outer shell formed of a nickel alloy and a core, formation of clearances can be prevented at the boundary between the outer shell and the core. In addition, since the core material is a composite material prepared by dispersing, in copper or a copper alloy exhibiting excellent thermal conductivity, carbon having a thermal conductivity several times higher than that of copper, the spark plug electrode exhibits good heat dissipation and thus excellent durability. Furthermore, the spark plug electrode exhibits favorable processability and thus applies a low load to a working jig.

Since the spark plug of the present invention includes an electrode exhibiting good heat dissipation, the spark plug exhibits excellent durability.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

The present invention will next be described by taking, as an example, a method for producing a center electrode.

Figure 1:
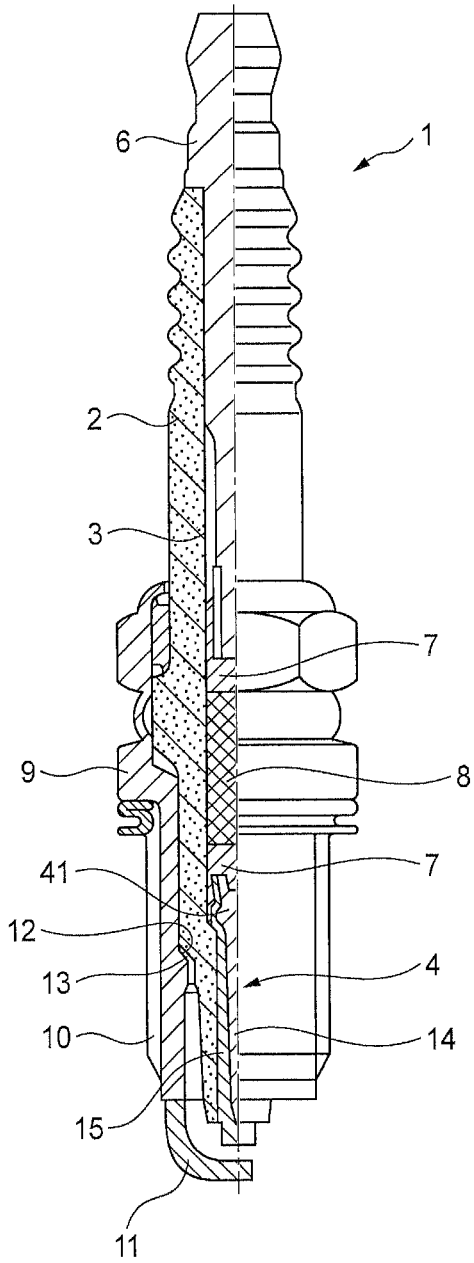
FIG. 1 is a cross-sectional view of an example of a spark plug.

FIG. 1 is a cross-sectional view of an example of a spark plug. As shown in FIG. 1, the spark plug 1 includes an insulator 2 having an axial hole 3; a center electrode 4 which has a guard and is held in the axial hole 3 at the front end thereof; a terminal electrode 6 and a resistor 8 which are inserted and held in the axial hole 3 at the rear end thereof so as to sandwich an electrically conductive glass sealing material 7; a metallic shell 9 in which the insulator 2 is fixed to a stepped portion 12 via a packing 13; and a ground electrode 11 provided at the front end of a threaded portion 10 of the metallic shell 9 so as to face the front end of the center electrode 4 held by the insulator 2.

In the present invention, the center electrode 4 includes a core 14 formed of a matrix metal in which carbon is dispersed, and an outer shell 15 which is formed of a nickel alloy and surrounds the core 14.

No particular limitation is imposed on the nickel alloy serving as the material of the outer shell, and the nickel alloy may be an Inconel (registered trademark, Special Metals Corporation; the same shall apply hereinafter) alloy or a high-Ni material (Ni≥96%).

The core material is a composite material prepared by dispersing carbon in a matrix metal, which is copper (exhibiting excellent thermal conductivity) or a metal containing copper as a main component (i.e., in the largest amount). The metal component which forms an alloy with copper may be, for example, chromium, zirconium, or silicon.

The carbon employed preferably exhibits a high thermal conductivity, more preferably 450 $W/m \cdot K^{-1}$ or more, much more preferably 600 $W/m \cdot K^{-1}$ or more, particularly preferably 700 $Wm \cdot K^{-1}$ or more. Specifically, the carbon is preferably in the form of carbon powder, carbon fiber, or carbon nanotube. Particularly, carbon nanotube is preferably employed, since it exhibits a thermal conductivity of 3,000 to 5,500 $W \cdot m^{-1} \cdot K^{-1}$ at room temperature, which is considerably higher than that of copper (i.e., 390 $W \cdot m^{-1} \cdot K^{-1}$). Carbon has a thermal expansion coefficient as low as, for example, 1.5 to $2 \times 10^{-6}$/K. Therefore, when carbon is employed in the core, the thermal expansion coefficient of the entire core can be lowered, and the difference in thermal expansion coefficient can be reduced between the core and the outer shell material (i.e., a nickel alloy).

In consideration of dispersibility or processability, there is preferably employed carbon nanotube having a mean length of 0.1 μm to 2,000 μm in the longitudinal direction (particularly preferably 2 μm to 300 μm), carbon powder having a mean particle size of 2 μm to 200 μm (particularly preferably 7 μm to 50 μm), or carbon fiber having a mean fiber length of 2 μm to 2,000 μm (particularly preferably 2 μm to 300 μm). In the case where any of the aforementioned carbon materials is employed, when the size or length thereof is smaller than the lower limit, the interface area between the matrix metal and carbon increases in the composite material, and thus segmentation occurs in the composite material, resulting in lowered ductility, or the effect of increasing strength is less likely to be attained. Therefore, when the composite material is formed into an electrode, voids may be generated in the electrode. The reason why the lower limit of the carbon nanotube length is smaller than that of the particle size or the fiber length is that carbon nanotube, which assumes a tubular shape, exhibits high adhesion strength to the matrix metal of the composite material (anchor effect), and thus voids are less likely to be generated in the composite material. In the case where any of the aforementioned carbon materials is employed, when the size or length thereof is greater than the upper limit, the theoretical density of the composite material is reduced. Therefore, when the composite material is formed into an electrode, voids tend to remain in the electrode. The composite material containing a large number of voids exhibits poor processability.

The carbon content of the composite material is 10 vol. % to 80 vol. %. The carbon content of the composite material is appropriately determined in consideration of the type of the matrix metal or carbon, the difference in thermal expansion coefficient between the composite material and a nickel alloy serving as the outer shell material, or the thermal conductivity of the composite material. The composite material employed preferably exhibits a high thermal conductivity, more preferably 450 W/m·K or more, particularly preferably 500 W/m·K or more.

Thermal conductivity and the carbon content of the composite material may be determined through the following method.

(1) Thermal Conductivity

Thermal conductivity is determined by means of a thermal microscope (TM, product of Bethel Co., Ltd.) employing the periodic heating method and the thermoreflectance method capable of measuring the thermal conductivity of a very small region.

(2) Carbon Content

The volume and weight of the composite material are measured, and only the matrix metal (e.g., copper) is dissolved in an acidic solution (e.g., sulfuric acid) by immersing the composite material in the solution. The weight of the matrix metal is calculated on the basis of the weight of the residue (i.e., carbon). The volume of the matrix metal is calculated on the basis of the weight and density of the matrix metal (e.g., density of copper: 8.93 $g/cm^3$). The carbon content of the composite material is calculated on the basis of the ratio of the volume of the matrix metal to that of the original composite material. When the matrix metal is an alloy, the composition of the alloy may be determined through quantitative analysis, and the density of an alloy having the same composition prepared through, for example, arc melting may be employed for calculation of the carbon content.

For production of the composite material, for example, powder of the matrix metal and carbon may be dry-mixed in the aforementioned proportions, and the resultant mixture may be subjected to powder compacting or sintering. Powder compacting is appropriately carried out by pressing at 100 MPa or higher. Sintering must be carried out at a temperature equal to or lower than the melting point of the matrix metal. When sintering is performed at ambient pressure, the sintering temperature is, for example, 90% of the melting point of the matrix metal. When sintering is performed under pressurized conditions (i.e., sintering is performed through HIP (e.g., 1,000 atm, 900° C.) or hot pressing), the sintering temperature can be lowered.

Alternatively, a calcined carbon product may be prepared, and the calcined product may be immersed in a molten matrix metal, to thereby impregnate the calcined product with the matrix metal.

Figure 2:
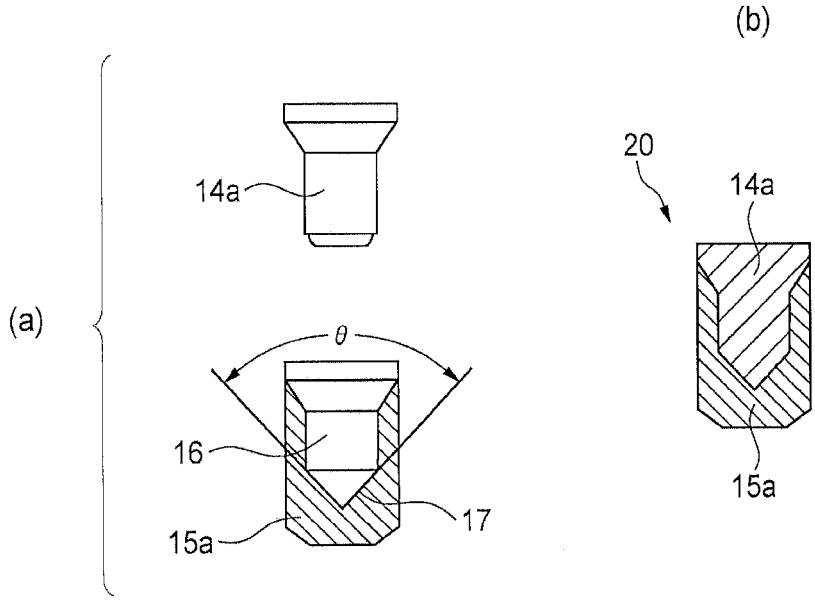
FIGS. 2(*a*) and 2(*b*) show a process for producing a work piece employed for production of a center electrode.

For production of the center electrode 4, firstly, as shown in FIG. 2(*a*), a columnar body 14*a* which is formed of the composite material and is to serve as the core 14 is placed in an interior portion 16 of a cup 15*a* which is formed of a nickel alloy and is to serve as the outer shell 15. As shown in FIG. 2(*a*), the bottom 17 of the interior portion 16 of the cup 15*a* may assume a fan-shaped cross section having a specific vertex angle θ. Alternatively, the bottom 17 may be flat. Subsequently, pressure is applied from above to the columnar body 14*a* placed in the cup 15*a*, to thereby form, as shown in FIG. 2(*b*), a work piece 20 including the cup 15*a* integrated with the columnar body 14*a*.

Figure 3:
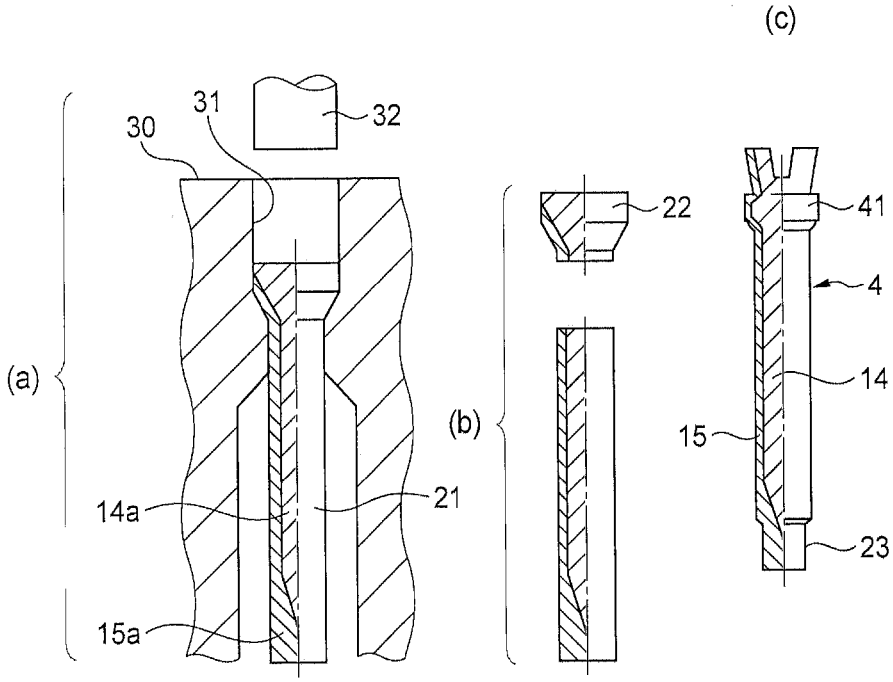
FIGS. 3(*a*) to 3(*c*) are half-sectioned views showing a process for extruding the work piece employed for production of a center electrode.

Next, as shown in FIG. 3(*a*), the work piece 20 is inserted into an insert portion 31 of a die 30, and pressure is applied from above to the work piece 20 by means of a punch 32, to thereby form a small-diameter portion 21 having specific dimensions. Then, as shown in FIG. 3(*b*), a rear end portion 22 is removed through cutting, and then the remaining small-diameter portion 21 is further subjected to extrusion molding. Finally, as shown in FIG. 3(*c*), there is produced the center electrode 4 having; on the front end side, a small-diameter portion 23 having a diameter smaller than that of the small-diameter portion 21, and having, at the rear end, a locking portion 41 which protrudes in a guard-like shape so as to be locked on the stepped portion 12 of the axial hole 3 of the insulator 2. The center electrode 4 includes the outer shell 15 formed of a nickel alloy, and the core 14 formed of the composite material. The aforementioned extrusion molding may be carried out under cold conditions.

Through the aforementioned extrusion molding, the work piece 20 shown in FIG. 2(*b*) extends in the direction of the axis, and the columnar body 14*a* also extends accordingly.

Therefore, in the composite material forming the columnar body 14*a* (i.e., the powder compact or sintered product formed of powder of the matrix metal and carbon, or the calcined carbon product impregnated with the matrix metal), carbon particles (or carbon nanotubes or fiber filaments) which have been linked together are separated from one another and dispersed in the matrix metal.

The present invention has been described above by taking, as an example, the method for producing the center electrode 4. Similar to the case of the center electrode 4, the ground electrode 11 may be configured so as to include the outer shell 15 formed of a nickel alloy, and the core 14 formed of the composite material. In such a case, the work piece 20 (including the cup 15*a* formed of a nickel alloy integrated with the columnar body 14*a* formed of the composite material) may be formed into a rod-shaped product through extrusion, and the thus-formed product may be bent so as to face the front end of the center electrode 4.

Figure 4:
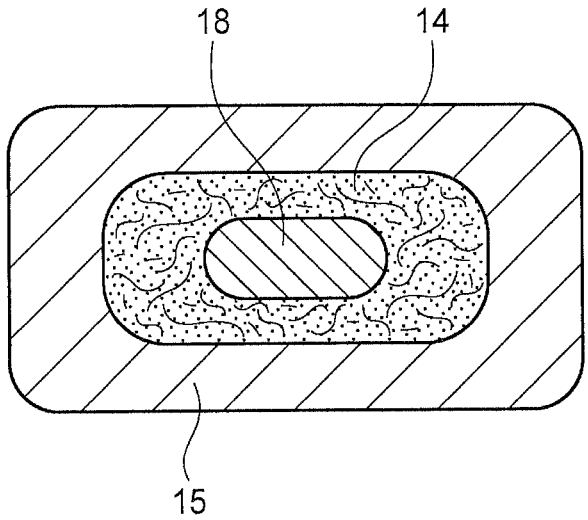
FIG. 4 is a schematic representation of another example of a ground electrode as viewed in cross section perpendicular to an axis.

As shown in FIG. 4 (as viewed in cross section perpendicular to the axis), the ground electrode 11 may have a three-layer structure including the core 14 formed of the composite material, the outer shell 15 formed of a nickel alloy, and a center member 18 formed of pure Ni and provided around the axis. Pure Ni plays a role in preventing deformation of the ground electrode 11; i.e., preventing bending of the ground electrode during production of the spark plug, or rising of the ground electrode after mounting of the spark plug on an engine. For formation of such a three-layer structure, as in the case of the work piece 20 shown in FIG. 2(*b*), a columnar body may be prepared by coating a core formed of pure Ni with the composite material, and the columnar body may be placed in the interior portion 16 of the cup 15*a*.

EXAMPLES

The present invention will next be further described with reference to the Examples and Comparative Examples, which should not be construed as limiting the invention thereto.

(Test 1)

As shown in Table 1, carbon materials having different thermal conductivities were provided, and composite materials were prepared by mixing copper with the carbon materials in different proportions. The thermal conductivity and carbon content of each composite material were determined through the methods described above in (1) and (2), respectively. For comparison, Inconel 601 containing no dispersed carbon (INC 601) was employed. The results are shown in Table 1.

As shown in FIGS. 2(*a*) and 2(*b*), each composite material was placed in a cup formed of a nickel alloy containing chromium (20 mass %), aluminum (1.5 mass %), iron (15 mass), and nickel (balance), to thereby form a work piece. The work piece was formed into a center electrode and a ground electrode through extrusion molding. Each of the thus-formed center electrode and ground electrode was cut along its axis. The cut surface was polished and then observed under a metallographic microscope for determining formation of clearances at the boundary between the outer shell and the core, or generation of voids in the core. The results are shown in Table 1. In Table 1, "Large void" corresponds to voids having a diameter of 100 μm or more; "Small void" corresponds to voids having a diameter of less than 100 μm; "Very small void" corresponds to voids having a diameter of 50 μm or less; "Small interfacial clearance" corresponds to interfacial clearances having a length of less than 100 μm; and "Large interfacial clearance" corresponds to interfacial clearances having a length of 100 μm or more.

A spark plug test sample was produced from the above-formed center electrode and ground electrode, and the spark plug test sample was attached to an engine (2,000 cc). The spark plug test sample was subjected to a cooling/heating cycle test. Specifically, the engine was operated at 5,000 rpm for one minute, and then idling was performed for one minute. This operation cycle was repeatedly carried out for 250 hours. After the test, the spark plug test sample was removed from the engine, and the gap between the center electrode and the ground electrode was measured by means of a projector, to thereby determine an increase in gap (i.e., the difference between the thus-measured gap and the initial gap).

The comprehensive evaluation of the spark plug test sample was determined according to the following criteria:

S: an increase in gap was 80 μm or less, and no voids were generated, or interfacial clearances were small;

A: an increase in gap was more than 80 μm and 100 μm or less, and no voids or very small voids were generated;

B: an increase in gap was 120 μm or less, and very small voids or small interfacial clearances were generated; and D: otherwise.

The results are shown in Table 1.

TABLE 1

| | | Carbon | | Matrix metal | | Composite material | Test results: Durability test results | | |
|---|---|---|---|---|---|---|---|---|---|
| | | Content (vol. %) | Thermal conductivity (W/m · K) | Metal species | Thermal conductivity (W/m · K) | Thermal conductivity (W/m · K) | Increase in gap (μm) | Void or clearance | Comprehensive evaluation |
| 1 | Comp. Ex. | 0 | — | INC601 | — | — | 238 | — | D |
| 2 | Comp. Ex. | 0 | — | Cu | 390 | 390 | 167 | Large void | D |
| 3 | Comp. Ex. | 5 | 350 | Cu | 390 | 388 | 152 | Small void | D |
| 4 | Comp. Ex. | 5 | 1000 | Cu | 390 | 410 | 131 | Small void | D |
| 5 | Ex. | 10 | 420 | Cu | 390 | 392 | 115 | Very small void | B |
| 6 | Ex. | 10 | 450 | Cu | 390 | 396 | 99 | Very small void | A |
| 7 | Ex. | 10 | 700 | Cu | 390 | 415 | 92 | Very small void | A |
| 8 | Ex. | 10 | 1000 | Cu | 390 | 432 | 85 | Very small void | A |
| 9 | Ex. | 20 | 420 | Cu | 390 | 399 | 106 | Very small void | B |
| 10 | Ex. | 20 | 450 | Cu | 390 | 402 | 97 | None | A |
| 11 | Ex. | 20 | 700 | Cu | 390 | 441 | 83 | None | A |
| 12 | Ex. | 20 | 1000 | Cu | 390 | 476 | 78 | None | S |
| 13 | Ex. | 30 | 420 | Cu | 390 | 396 | 110 | None | B |
| 14 | Ex. | 30 | 450 | Cu | 390 | 407 | 95 | None | A |
| 15 | Ex. | 30 | 700 | Cu | 390 | 468 | 49 | None | S |

TABLE 1-continued

| | | Carbon | | Matrix metal | | Composite material | Test results | | |
|---|---|---|---|---|---|---|---|---|---|
| | | | | | | | Durability test results | | |
| | | Content (vol. %) | Thermal conductivity (W/m · K) | Metal species | Thermal conductivity (W/m · K) | Thermal conductivity (W/m · K) | Increase in gap (μm) | Void or clearance | Comprehensive evaluation |
| 16 | Ex. | 30 | 1000 | Cu | 390 | 524 | 43 | None | S |
| 17 | Ex. | 50 | 420 | Cu | 390 | 409 | 112 | None | B |
| 18 | Ex. | 50 | 450 | Cu | 390 | 419 | 89 | None | A |
| 19 | Ex. | 50 | 700 | Cu | 390 | 527 | 42 | None | S |
| 20 | Ex. | 50 | 1000 | Cu | 390 | 632 | 35 | None | S |
| 21 | Ex. | 60 | 420 | Cu | 390 | 396 | 110 | None | B |
| 22 | Ex. | 60 | 450 | Cu | 390 | 425 | 89 | None | A |
| 23 | Ex. | 60 | 700 | Cu | 390 | 558 | 40 | None | S |
| 24 | Ex. | 60 | 1000 | Cu | 390 | 693 | 31 | None | S |
| 25 | Ex. | 70 | 420 | Cu | 390 | 397 | 110 | None | B |
| 26 | Ex. | 70 | 450 | Cu | 390 | 431 | 85 | None | A |
| 27 | Ex. | 70 | 700 | Cu | 390 | 591 | 56 | None | S |
| 28 | Ex. | 70 | 1000 | Cu | 390 | 759 | 49 | None | S |
| 29 | Ex. | 80 | 420 | Cu | 390 | 421 | 118 | Small interfacial clearance | B |
| 30 | Ex. | 80 | 450 | Cu | 390 | 428 | 92 | Small interfacial clearance | A |
| 31 | Ex. | 80 | 700 | Cu | 390 | 626 | 79 | Small interfacial clearance | S |
| 32 | Ex. | 80 | 1000 | Cu | 390 | 832 | 65 | Small interfacial clearance | S |
| 33 | Comp. Ex. | 83 | 420 | Cu | 390 | 423 | 136 | Large interfacial clearance | D |
| 34 | Comp. Ex. | 83 | 450 | Cu | 390 | 440 | 130 | Large interfacial clearance | D |
| 35 | Comp. Ex. | 83 | 700 | Cu | 390 | 632 | 129 | Large interfacial clearance | D |
| 36 | Comp. Ex. | 83 | 1000 | Cu | 390 | 849 | 122 | Large interfacial clearance | D |
| 37 | Comp. Ex. | 85 | 420 | Cu | 390 | 426 | — | — | D |
| 38 | Comp. Ex. | 85 | 450 | Cu | 390 | 441 | — | — | D |
| 39 | Comp. Ex. | 85 | 700 | Cu | 390 | 643 | — | — | D |
| 40 | Comp. Ex. | 85 | 1000 | Cu | 390 | 871 | — | — | D |

As shown in Table 1, in the case where the core is formed of a composite material having a carbon content of 10 vol. % to 80 vol. %, the amount of erosion is reduced (which is attributed to improved heat dissipation of the electrode), and an increase in gap is suppressed. Also, in this case, generation of voids is suppressed in the core, or formation of clearances is suppressed at the boundary between the outer shell and the core. In contrast, in the case where the core is formed of a composite material having a carbon content of less than 10 vol. %, an increase in gap is observed, and voids are generated. Also, in the case where the core is formed of a composite material having a carbon content of more than 80 vol. %, although the composite material exhibits high thermal conductivity, interfacial clearances are generated. Particularly when the carbon content of a composite material was 85 vol. %, difficulty was encountered in forming the core into an electrode. Therefore, when a composite material having a carbon content of 85 vol. % was employed, neither measurement of an increase in gap, nor observation of a cut surface was carried out.

(Test 2)

As shown in Table 2, carbon powders having different mean particle sizes or carbon fibers having different mean fiber lengths were provided, and composite materials (carbon content: 40 vol. %) were prepared by mixing copper with the carbon powders or the carbon fibers. The theoretical density of each composite material was determined. Table 2 shows the ratio of the actual density of the composite material to the theoretical density thereof (hereinafter the ratio will be referred to as "theoretical density ratio").

In a manner similar to that of test 1, each composite material was placed in a cup formed of a nickel alloy, and the resultant work piece was formed into a center electrode and a ground electrode. The processability of the work piece into the electrode was evaluated. The results are shown in Table 2. For evaluation of processability, each of the thus-formed center electrode and ground electrode was cut along its axis, and the cut surface was polished and then observed under a metallographic microscope. Processability was evaluated according to the following criteria in terms of the distance between the front end of the nickel electrode (outer shell) and the position of the composite material (target of the distance: 4 mm):

A: 4.5 mm or less;

B: 5 mm or less;

C: 5.5 mm or less; and

D: more than 5.5 mm.

Furthermore, the cut surface was observed under a metallographic microscope in a manner similar to that of test 1 for determining the presence or absence of voids in the core. In Table 2, "None" corresponds to the case of generation of no voids; and "Very small," "Small," or "Large" corresponds to the case of generation of voids having a diameter of less than 30 μm, 30 to 50 μm, or more than 50 μm, respectively.

TABLE 2

| | | Carbon content | Matrix metal | Carbon Form | Carbon Size | Composite material Theoretical density ratio | Processing of electrode material Processability | Processing of electrode material Cut surface | Evaluation |
|---|---|---|---|---|---|---|---|---|---|
| 41 | Ex. | 40 | Cu | Particles | 1 | 99.4 | B | Void, Small | C |
| 42 | Ex. | 40 | Cu | | 2 | 99.5 | A | None | B |
| 43 | Ex. | 40 | Cu | | 7 | 99.4 | A | None | B |
| 44 | Ex. | 40 | Cu | | 15 | 99.5 | A | None | B |
| 45 | Ex. | 40 | Cu | | 50 | 99.0 | A | None | B |
| 46 | Ex. | 40 | Cu | | 150 | 95.2 | B | None | B |
| 47 | Ex. | 40 | Cu | | 209 | 89.4 | C | Void, Small | C |
| 48 | Ex. | 40 | Cu | | 220 | 87.3 | C | Void, Large | C |
| 49 | Ex. | 40 | Cu | Fiber | 1 | 99.5 | B | Void, Small | C |
| 50 | Ex. | 40 | Cu | | 5 | 99.4 | A | None | B |
| 51 | Ex. | 40 | Cu | | 7 | 99.5 | A | None | B |
| 52 | Ex. | 40 | Cu | | 15 | 99.7 | A | None | B |
| 53 | Ex. | 40 | Cu | | 50 | 99.5 | A | None | B |
| 54 | Ex. | 40 | Cu | | 300 | 97.2 | A | None | B |
| 55 | Ex. | 40 | Cu | | 500 | 96.0 | B | None | B |
| 56 | Ex. | 40 | Cu | | 900 | 93.5 | B | None | B |
| 57 | Ex. | 40 | Cu | | 1300 | 92.6 | B | None | B |
| 58 | Ex. | 40 | Cu | | 1800 | 91.3 | C | None | B |
| 59 | Ex. | 40 | Cu | | 2000 | 90.1 | C | Void, Very small | B |
| 60 | Ex. | 40 | Cu | | 2010 | 88.4 | C | Void, Small | C |
| 61 | Ex. | 40 | Cu | | 2100 | 87.2 | C | Void, Large | C |

As shown in Table 2, as carbon size increases, theoretical density ratio decreases, processability is impaired, and large voids are likely to be generated. This tendency is pronounced particularly when the mean particle size of carbon powder exceeds 200 μm, or the mean fiber length of carbon fiber exceeds 2,000 μm.

Although the present invention has been described in detail with reference to specific embodiments, it will be apparent to those skilled in the art that a variety of modifications or changes may be made without departing from the spirit and scope of the invention.

The present application is based on Japanese Patent Application No. 2010-213830 filed on Sep. 24, 2010, which is incorporated herein by reference.

INDUSTRIAL APPLICABILITY

According to the present invention, there is provided a center electrode or ground electrode exhibiting favorable thermal conductivity and good heat dissipation, by virtue of the small difference in thermal expansion coefficient between an outer shell and a core. Therefore, a spark plug including the electrode exhibits excellent durability.

DESCRIPTION OF REFERENCE NUMERALS

1: spark plug
2: insulator
3: axial hole
4: center electrode
6: terminal electrode
7: electrically conductive glass sealing material
8: resistor
9: metallic shell
10: threaded portion
11: ground electrode
12: stepped portion
13: packing
14: core
15: outer shell
**14*a***: columnar body
**15*a***: cup
20: work

The invention claimed is:

1. A spark plug electrode for use as at least one of a center electrode and a ground electrode, the electrode comprising:

a core formed of a composite material containing a matrix metal, the matrix metal being copper or a metal containing copper as a main component carbon being dispersed in the matrix metal in an amount of 10 to 80 vol. %, said carbon having a thermal conductivity higher than that of the matrix metal; and an outer shell which surrounds at least a portion of the core and which is formed of nickel or a metal containing nickel as a main component.

2. The spark plug electrode according to claim 1, wherein a thermal conductivity of the carbon is 450 W/m·K or more.

3. The spark plug electrode according to claim 1, wherein a thermal conductivity of the composite material is 450 W/m·K or more.

4. The spark plug electrode according to claim 1, wherein the carbon is at least one species selected from the group consisting of carbon powder, carbon fiber, and carbon nanotube.

5. The spark plug electrode according to claim 4, wherein the carbon powder has a mean particle size of 2 μm to 200 μm.

6. The spark plug electrode according to claim 4, wherein the carbon fiber has a mean fiber length of 2 μm to 2,000 μm.

7. The spark plug electrode according to claim 4, wherein a mean length of the carbon nanotube in a longitudinal direction is 0.1 μm to 2,000 μm.

8. A spark plug comprising:

at least one of the center electrode and the ground electrode according to claim 1;

an insulator having an axial hole extending in a direction of an axis;

a center electrode held in the axial hole;

a metallic shell provided around the insulator; and a ground electrode which is provided such that a proximal end portion of the ground electrode is bonded to the metallic shell, and a gap is formed between a distal end portion of the ground electrode and a front end portion of the center electrode.

9. A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method comprising a step of producing at least one of the center electrode and the ground electrode, said step comprising the sub-steps of:

mixing a matrix metal, the matrix metal being copper or a metal containing copper as a main component, with carbon having a thermal conductivity higher than that of the matrix metal so that the carbon content of the resultant mixture is adjusted to 10 to 80 vol. %;

subjecting the mixture to powder compacting or sintering, to thereby form a core;

placing the core in a cup formed of nickel or a metal containing nickel as a main component; and subjecting the cup to cold working.

10. A method for producing a spark plug comprising:

an insulator having an axial hole extending in a direction of an axis;

a center electrode held in the axial hole on a front end side of the axis;

a metallic shell provided around the insulator; and a ground electrode which is provided such that a proximal end portion of the ground electrode is bonded to the metallic shell, and a gap is formed between a distal end portion of the ground electrode and a front end portion of the center electrode, the method comprising a step of producing at least one of the center electrode and the ground electrode, said step comprising the sub-steps of:

preparing a molten product of a matrix metal, the matrix metal being copper or a metal containing copper as a main component;

impregnating a calcined product of carbon having a thermal conductivity higher than that of the matrix metal with the matrix metal so that the carbon content of the impregnated product is adjusted to 10 to 80 vol. %, to thereby form a core;

placing the core in a cup formed of nickel or a metal containing nickel as a main component; and subjecting the cup to cold working.

11. A method for producing at least one of a center electrode and a ground electrode for a spark plug, the method comprising the steps of:

mixing a matrix metal, the matrix metal being copper or a metal containing copper as a main component, with carbon having a thermal conductivity higher than that of the matrix metal so that the carbon content of the resultant mixture is adjusted to 10 to 80 vol. %;

subjecting the mixture to powder compacting or sintering, to thereby form a core;

placing the core in a cup formed of nickel or a metal containing nickel as a main component; and subjecting the cup to cold working so as to achieve a specific shape.

12. A method for producing at least one of a center electrode and a ground electrode for a spark plug, the method comprising the steps of:

preparing a molten product of a matrix metal, the matrix metal being copper or a metal containing copper as a main component; impregnating a calcined product of carbon having a thermal conductivity higher than that of the matrix metal with the matrix metal so that the carbon content of the impregnated product is adjusted to 10 to 80 vol. %, to thereby form a core;

placing the core in a cup formed of nickel or a metal containing nickel as a main component; and subjecting the cup to cold working so as to achieve a specific shape.

13. The spark plug electrode according to claim 2, wherein a thermal conductivity of the composite material is 450 W/m·K or more.

14. The spark plug electrode according to claim 2, wherein the carbon is at least one species selected from the group consisting of carbon powder, carbon fiber, and carbon nanotube.

15. The spark plug electrode according to claim 3, wherein the carbon is at least one species selected from the group consisting of carbon powder, carbon fiber, and carbon nanotube.

* * * * *